US008151939B2

(12) United States Patent
Osborne

(10) Patent No.: US 8,151,939 B2
(45) Date of Patent: Apr. 10, 2012

(54) FOLDING SAWHORSE BRACKETS

(76) Inventor: John M. Osborne, Toano, VA (US)

( * ) Notice: Subject to any disclaimer, the term of this patent is extended or adjusted under 35 U.S.C. 154(b) by 1023 days.

(21) Appl. No.: 12/081,840

(22) Filed: Apr. 22, 2008

(65) Prior Publication Data

US 2009/0260921 A1 Oct. 22, 2009

(51) Int. Cl.
*E04G 1/34* (2006.01)

(52) U.S. Cl. ..... 182/155; 182/186.3

(58) Field of Classification Search ..... 182/153, 182/155, 225, 181.1, 186.3
See application file for complete search history.

(56) References Cited

U.S. PATENT DOCUMENTS

| | | | | | |
|---|---|---|---|---|---|
| 2,412,764 | A | * | 12/1946 | Beasley | 182/129 |
| 3,078,957 | A | | 2/1963 | Larson | |
| 3,269,487 | A | * | 8/1966 | Larson | 182/155 |
| 3,618,704 | A | | 11/1971 | Smith, Sr. | |
| 3,627,075 | A | | 12/1971 | Enders et al. | |
| 3,700,072 | A | * | 10/1972 | Lovett | 182/155 |
| 3,951,233 | A | | 4/1976 | Meyers | |
| 4,804,064 | A | | 2/1989 | Coultrup et al. | |
| D308,728 | S | | 6/1990 | Carlson | |
| 5,102,078 | A | | 4/1992 | Nordeng | |
| D334,811 | S | | 4/1993 | Parks et al. | |
| 5,542,639 | A | * | 8/1996 | Wixey et al. | 248/439 |
| 6,564,903 | B2 | | 5/2003 | Krajec | |
| 6,612,401 | B1 | | 9/2003 | Price et al. | |
| 6,681,895 | B2 | * | 1/2004 | Virtue | 182/186.3 |
| 6,810,996 | B2 | | 11/2004 | Rump | |
| 6,896,102 | B1 | * | 5/2005 | Nichol | 182/186.5 |
| 7,458,403 | B2 | * | 12/2008 | Radermacher | 144/286.1 |
| 2002/0038741 | A1 | | 4/2002 | Krajec | |
| 2004/0124036 | A1 | * | 7/2004 | Ulshafter, Jr. | 182/153 |

OTHER PUBLICATIONS

Website, http://www.epinions.com/Fulton_Sawhorse_Bracket_400SHB_Shop_Tools, review of Fulton sawhorse bracket model 400SHB, four sheets printed from the internet on Feb. 29, 2008.

* cited by examiner

*Primary Examiner* — Alvin Chin Shue
(74) *Attorney, Agent, or Firm* — Richard C. Litman

(57) ABSTRACT

The folding sawhorse brackets are each formed of a single sheet of flat stock, formed to affix a rail therein and pivotally attach two legs thereto. All embodiments accept stock dimensions of lumber or other suitable materials for the rail and legs. A first configuration has two brackets, with one having its two leg pivots closer to the rail than the other. The closer legs fold immediately adjacent to the rail with the opposite legs folding outboard of the closer legs, with all legs and the rail lying in a compact parallel relationship when folded. A second configuration has two identical brackets, each bracket having one closer and one more distant pivot point from the rail. When two such brackets are assembled at opposite rail ends, they are in mirror image to one another with one closer and one more distant leg folding on each side of the rail.

6 Claims, 4 Drawing Sheets

FOLDING SAWHORSE BRACKETS

BACKGROUND OF THE INVENTION

1. Field of the Invention

The present invention relates generally to carpentry and construction tools, and more particularly to folding sawhorse brackets that are used to form sawhorses having folding legs for compact storage.

2. Description of the Related Art

Sawhorses formed of four legs supporting a single rail or crossmember have been used for decades, if not centuries, to provide temporary and semi-permanent support for various articles under construction or as support for makeshift tables, workbenches, and the like. Traditionally, sawhorses were constructed as rigid, non-folding devices with carefully mitered joints and gussets at all joints to form a sturdy structure. More recently, the value of disassembly for storage or transport has been recognized, as well as the value of the labor saved in the ability to rapidly assemble and disassemble a sawhorse. Accordingly, a number of different brackets have been developed to use legs and rails of standard lumber dimensions, e.g., the nominal "two by four" of 1.5×3.5 inches. Many of these prefabricated brackets allow the legs of the sawhorse to fold, as well.

Prefabricated sawhorse brackets can generally be divided into two groups: (1) single piece brackets, and (2) multiple piece brackets. Heretofore, sawhorses with folding legs have nearly always required multiple piece brackets at each end of the rail or crossmember, if not a separate bracket for each leg. While some sawhorses with brackets formed as a single rigid component have permitted the legs to fold, these sawhorses were specially manufactured and could not be adapted to use lumber stock of standard dimensions. Other single-piece sawhorse brackets utilizing standard dimension lumber have been developed, but these do not permit the legs to fold.

Thus, folding sawhorse brackets solving the aforementioned problems is desired.

SUMMARY OF THE INVENTION

The folding sawhorse brackets are each formed of a single sheet of flat stock sheet metal, bent to form the proper bracket configuration. The brackets are of generally triangular configuration, with extensions forming the attachment plates or ears for the rail or crossmember and the legs. Double plates or flanges are provided to capture the ends of all of the elongate elements (rail and legs) therebetween, for additional strength and rigidity. The brackets are adapted to use appropriate lengths of standard lumber stock, e.g., "two-by-four" studs or the like having nominal cross sectional dimensions of 1.5×3.5 inches. The brackets may be configured to accept other lumber dimensions, as desired.

In a first embodiment, two different bracket configurations are provided, with each end of the rail or crossmember being supported by a bracket of different configuration than the other. One end utilizes a larger bracket, with the pivot points for each leg being farther separated from the end of the rail or crossmember than the smaller bracket at the opposite end. This allows the legs attached at the smaller bracket to fold more closely to the rail, while the legs extending from the larger bracket fold to lie immediately outboard of the opposite legs. This permits all of the legs to fold parallel to the crossmember or rail, to optimize compact storage.

A second embodiment employs two identical brackets with each bracket having a short side and a long side, i.e., the leg pivot point on one side of the bracket is farther removed from the rail than the leg pivot point on the opposite side of the rail. When two such brackets are used in mirror image to one another at opposite ends of the rail, the short side of one bracket is disposed on the same side of the rail as the long side of the opposite bracket. Thus, the legs can fold to overlie and underlie one another parallel to the rail or main beam, just as in the first embodiment employing a different bracket at each end of the rail.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to brackets for a folding sawhorse, and a sawhorse having folding legs and using the brackets. In each of the embodiments of the folding sawhorse brackets, the legs of the sawhorse pivot to lie parallel to the rail or crossmember of the sawhorse when folded, with two legs disposed immediately adjacent to the rail and the other two legs positioned immediately outboard of the first two legs. A sawhorse constructed using either embodiment of the brackets requires minimal storage space when folded.

Figure 1:
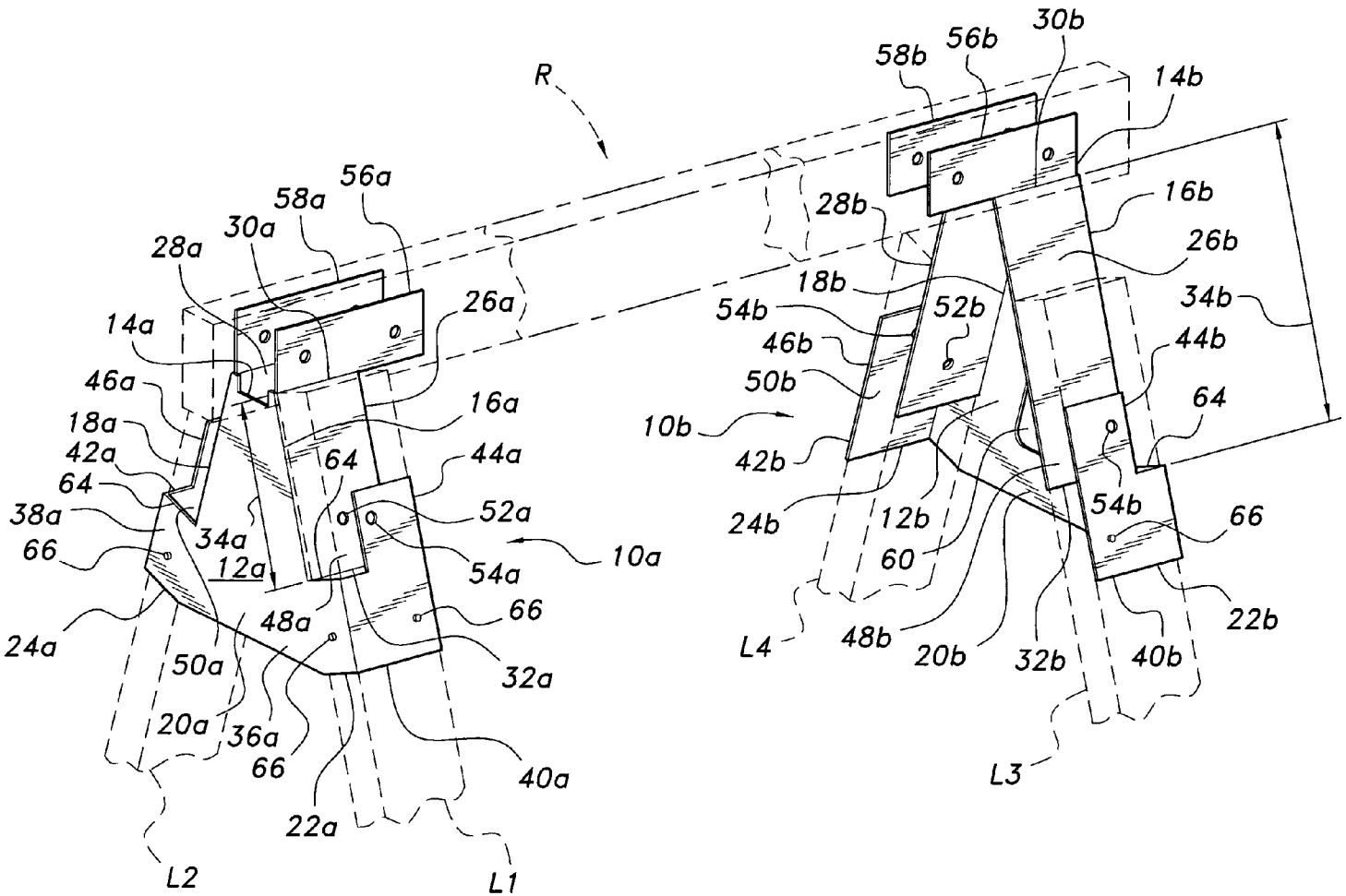
FIG. 1 is a perspective view of a first embodiment pair of folding sawhorse brackets according to the present invention, showing their installation to form a sawhorse.
Figure 2:
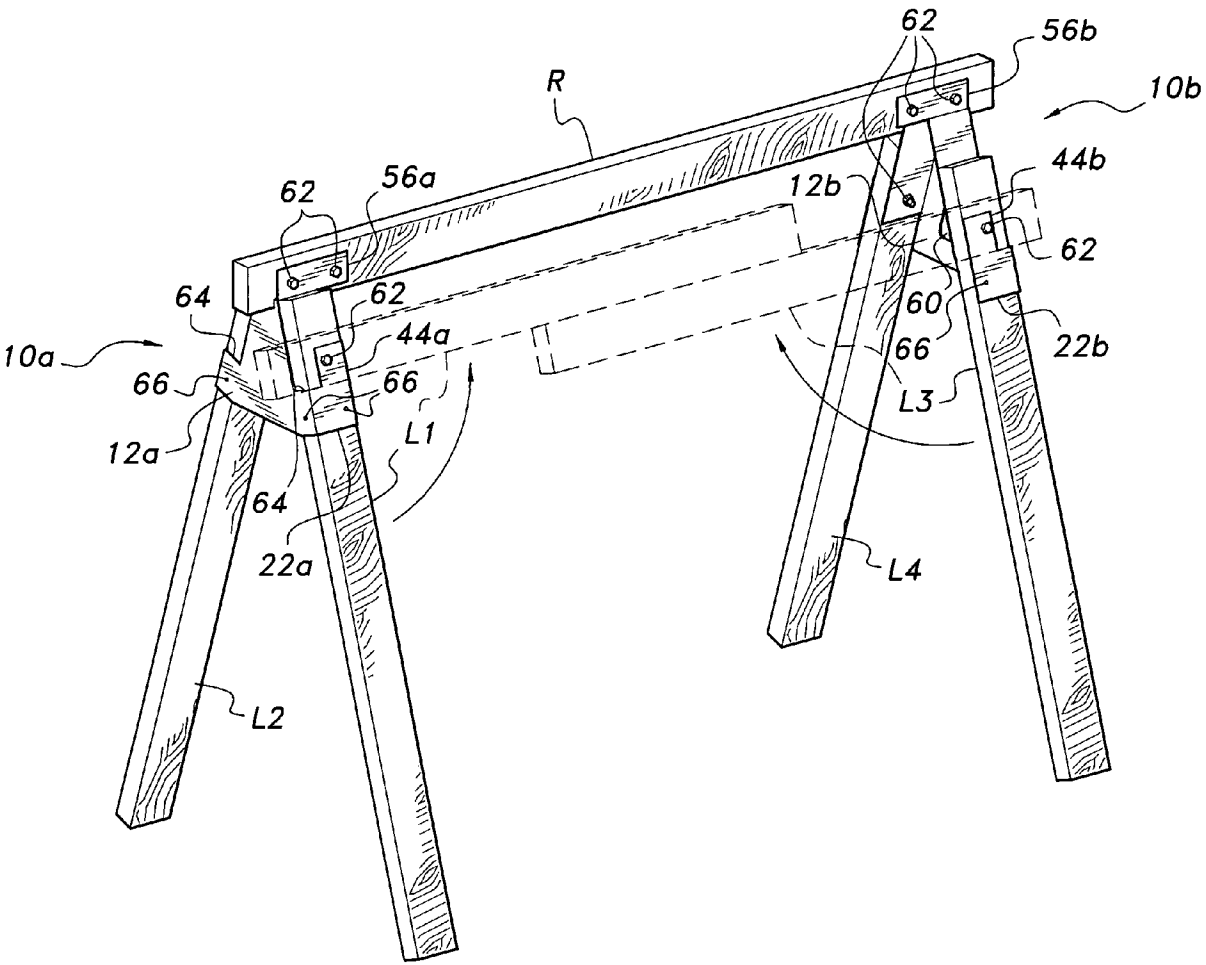
FIG. 2 is a perspective view of a sawhorse assembled with the folding sawhorse brackets of FIG. 1, showing the folding operation of the sawhorse legs.
Figure 3:
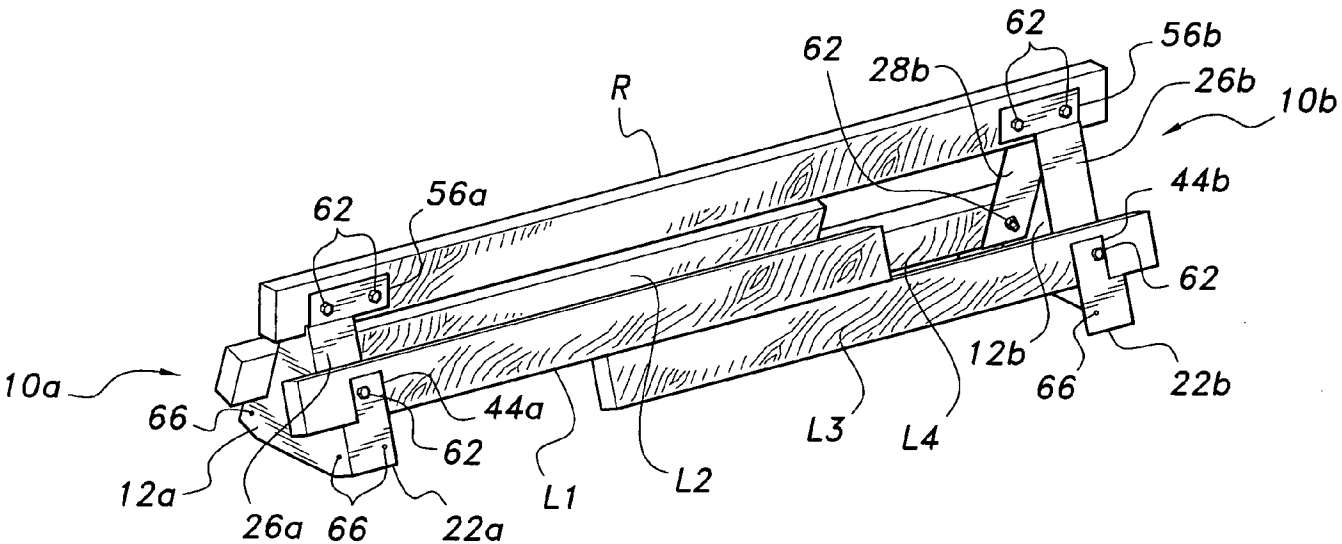
FIG. 3 is a perspective view of the sawhorse of FIG. 2, showing its legs in a folded configuration.

FIGS. 1 through 3 of the drawings illustrate a first embodiment of the brackets, respectively designated as first and second brackets 10*a* and 10*b*, and the rail R and legs L1 through L4 forming a sawhorse when assembled with the two brackets. Each of the brackets 10*a* and 10*b* includes a generally triangular central web, respectively 12*a* and 12*b*, with each web having an upper end, respectively 14*a* and 14*b*, a first edge, respectively 16*a* and 16*b*, an opposite second edge, respectively 18*a* and 18*b*, and a lower portion, respectively 20*a* and 20*b*. Most of these features are most clearly shown in FIG. 1 of the drawings.

Each of the edges of the central webs 12*a*, 12*b* has a leg attachment set extending therefrom, respectively first and second leg attachment sets 22*a* and 24*a* for the first and second edges 18*a*, 20*a* of the first bracket 10*a*, and first and second leg attachment sets 22*b* and 24*b* for the first and second edges 18*b*, 20*b* of the second bracket 10*b*. A first leg inner attachment flange, respectively 26*a* and 26*b*, extends from the first edge 16*a*, 16*b* of the two brackets 10*a* and 10*b* and is bent or folded to lie normal to the plane of the respective central web. Second leg inner attachment flanges, respectively 28*a* and 28*b*, extend from the opposite second edges 18*a*, 18*b*, in mirror image to the first leg inner attachment flanges. Each of these inner attachment flanges 26*a* through 28*b* extends downwardly from the upper end 14*a* or 14*b* of the respective bracket 10*a* or 10*b*. Each of these inner attachment flanges has an upper end, e.g., 30*a* and 30*b* for the first leg inner attachment flanges 26*a* and 26*b* as shown in FIG. 1, generally conterminous with the upper ends 14*a*, 14*b* of the two brackets. Each of the inner flanges, e.g., 26*a*, 26*b*, also has an opposite lower end, respectively 32*a*, 32*b* for the first leg inner attachment flanges 26*a*, 26*b*, with the opposite ends of each inner flange defining an inner flange height, respectively 34*a*, 34*b* for the first leg inner flanges for the two brackets 10*a*, 10*b*. The opposite second leg inner flanges are configured in mirror image to the first leg inner flanges.

Each of the leg attachment sets 22*a* through 24*b* further includes a leg pivot limit flange, e.g., opposite first and second leg limit flanges 36*a* and 38*a* extending from the lower portion 20*a* of the central web 12*a* of the first bracket 10*a*. (A portion of the second leg pivot limit flange 38*b* of the second bracket 10*b* is also visible in FIG. 1.) The upper edges of these leg pivot limit flanges are conterminous with the lower edges of the corresponding inner attachment flanges 26*a* through 28*b* and serve to limit both the extension and the folding of the sawhorse legs L1 through L4, as explained further below.

An outer leg attachment flange, respectively 40*a* through 42*b*, extends respectively from each of the leg pivot limit flanges and normal thereto and to the plane of the respective central web to lie parallel to the corresponding inner leg attachment flange 26*a* through 28*b*. Each of the outer leg attachment flanges includes an upwardly extending ear, respectively 44*a* through 46*b*, with each ear overlying the lower portion of the corresponding inner attachment flange 26*a* through 28*b* to define a leg attachment receptacle, respectively 48*a* through 50*b*, therebetween. Thus, each of the four sawhorse legs is pivotally captured between its inner leg flange and corresponding ear of the outer leg flange, i.e., the first leg L1 is captured between the first inner flange 26*a* and corresponding first outer flange ear 44*a*, the second leg L2 is captured between the second leg inner flange and its outer flange ear 46*a*, the third leg L3 is captured between the third leg inner flange 26*b* of the second bracket 10*b* and its ear 44*b*, and the fourth leg L4 is captured between the fourth leg inner flange 28*b* and its corresponding ear 46*b*.

It will be seen that the first leg inner flange 26*b* of the second bracket 10*b* has a considerably greater height 34*b* than the height 34*a* of the first leg inner flange 26*a* of the first bracket 10*a*. This results in the leg inner and outer pivot passages 52*b*, 54*b* of the second bracket 10*b* being somewhat farther below the corresponding leg pivot passages 52*a*, 54*a* of the first bracket 10*a*, as all of the components of the leg attachment sets 22*b*, 24*b* of the taller second bracket 10*b* are displaced downwardly or farther from the respective apex or upper end 14*b* of the bracket 10*b*, than is the case for the components of the leg attachment sets 22*a*, 24*a* of the shorter first bracket 10*a*. The relative heights of these various components, i.e., their distances from the upper ends 14*a*, 14*b* of the two brackets 10*a*, 10*b*, are predetermined to position the first and second leg inner and outer pivot passages 52*a*, 54*a* of the first bracket 10*a* so that the first and second legs L1 and L2 lie immediately adjacent the rail R when the two legs L1 and L2 are folded, as shown in broken lines in FIG. 2 and in solid lines in FIG. 3 of the drawings. The greater distance of the pivot passages 52*b*, 54*b* from the apex or upper end 14*b* of the bracket 10*b* results in those legs L3 and L4 folding to lie outboard of the first and second legs L1 and L2 extending from the first bracket 10*a*, as shown in FIGS. 2 and 3.

All of the legs L1 through L4 fold to lie parallel to the rail or crossmember R, which is secured between the respective first and second rail attachment flanges 56*a*, 58*a* of the first bracket 10*a* and 56*b*, 58*b* of the second bracket 10*b*. It will be noted that the upper edges of the rail attachment flanges 56*a* through 58*b* are preferably somewhat below the top of the rail R. This precludes contact of a cutting blade (e.g., circular saw, etc.) with the rail attachment flanges when material placed upon the top of the sawhorse is being cut, even if the blade extends slightly below the workpiece and cuts into the upper surface of the underlying rail R. The rail R is easily replaced by removing two bolts or fasteners holding each end of the rail within the attachment flanges of each of the brackets 10*a* and 10*b*. The additional height of the second bracket 10*b* also provides a greater area for the central web 12*b* thereof, permitting an accessory attachment passage 60 to be formed therein. The accessory attachment passage 60 allows the belt clip or similar attachment structure of a retractable steel tape, etc. to be conveniently hung on the lower edge of the passage. A similar but smaller passage (not shown) may be formed through the web 12*a* of the smaller bracket 10*a*, if so desired.

Conventional bolts and nuts 62, the ends of which are shown in FIGS. 2 and 3, are used to pivotally secure the legs L1 through L4 in their respective leg receptacles 48*a* through 50*b* and to immovably affix the opposite ends of the rail R between the respective rail attachment flanges 56*a* through 58*b*. These bolt and nut assemblies 62 may be tightened as desired to adjust the friction of the legs L1 through L4 relative to the inner and outer leg attachment flanges. These fastener assemblies 62 also strengthen the entire sawhorse apparatus by tying each inner and outer leg attachment flange pair together, with the solid material of the upper end of each leg preventing the collapse of the two plates toward one another. The result is an extremely sturdy and solid structure.

The leg attachment passages 52*a* through 54*b* formed through the various inner and outer leg attachment flanges 26*a* through 28*b* and ears 44*a* through 46*b* are precisely located to limit the legs L1 through L4 in both their extension and retraction. Actually, this is not so much a function of the precise positioning of the leg attachment passages as it is the precise positioning of the legs L1 through L4 when they are initially positioned for drilling attachment holes through the upper ends of the legs, using the various flange and ear attachment passages as guides. When properly attached legs L1 through L4 are extended, as shown in FIG. 1 in broken lines and in FIG. 2 in solid lines, the outboard edges of the legs contact the inner surfaces of the corresponding leg pivot limit flanges 36*a* through 38*b*, limiting extension of the legs to an orientation normal to the rail R. Conversely, when the legs are folded, the outer edges of the legs contact the upper edges 64 of the corresponding limit flanges to prevent the legs from pivoting past parallel to the rail R. In some instances, it may be desirable to affix the legs L1 through L4 immovably in their brackets 10*a* and 10*b*. This may be accomplished by driving locking pins (e.g., nails, wood screws, etc.) into preformed locking pin passages 66 formed through the outer attachment flanges 40*a* through 42*b* and leg pivot limit flanges 36*a* through 38*b*.

Figure 4:
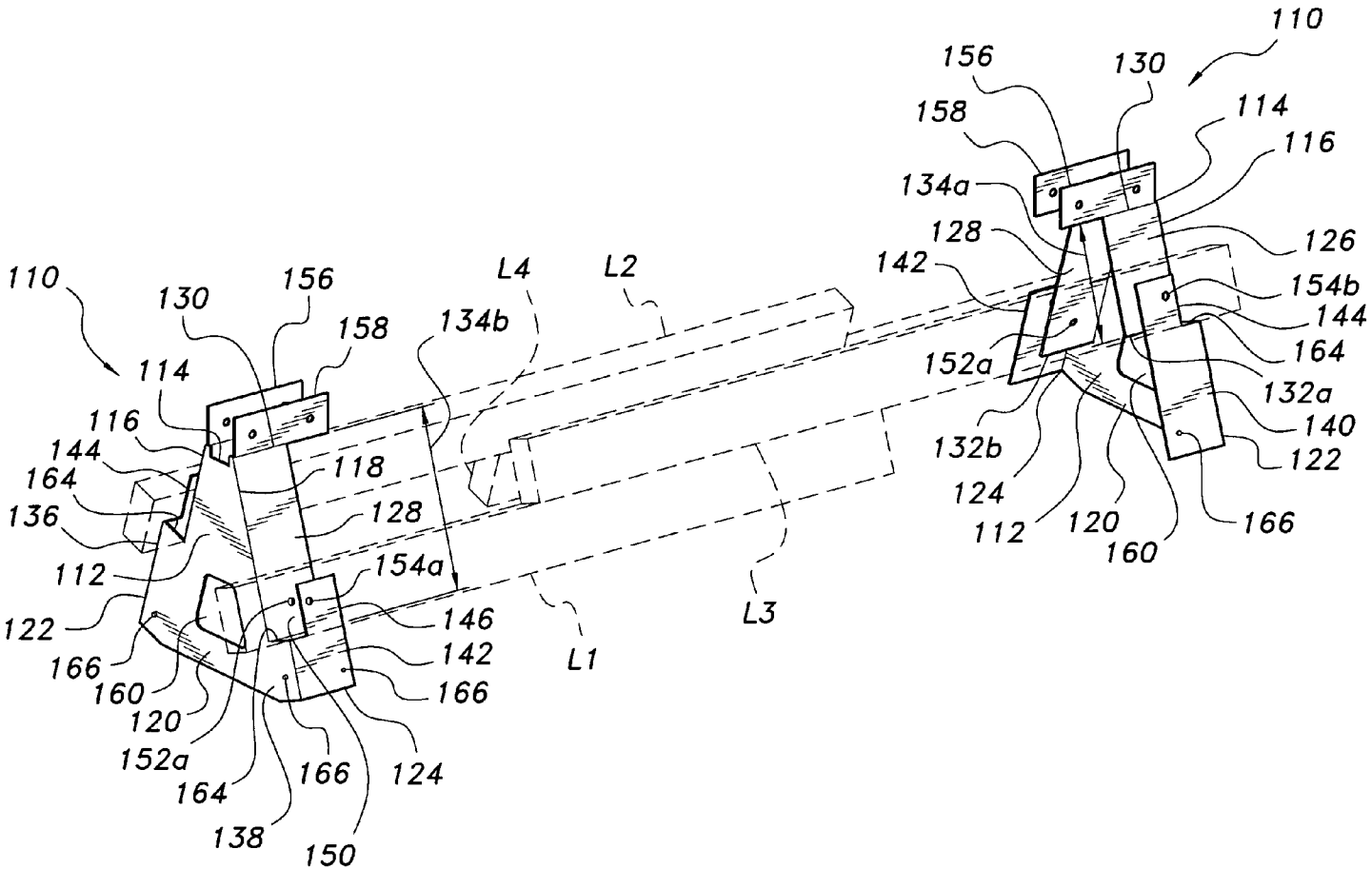
FIG. 4 is a perspective view of an alternative embodiment of folding sawhorse brackets according to the present invention, showing the folded configuration of the four legs less the crossmember for clarity in the drawing Fig.

FIG. 4 is a perspective view similar in orientation to FIG. 1, but illustrating a different embodiment of folding sawhorse brackets than the embodiment shown in FIG. 1. In FIG. 4, two identical brackets 110 are shown, but rather than being laterally symmetrical, as are the brackets 10*a* and 10*b* of FIGS. 1 through 3, the brackets 110 are laterally asymmetrical, with one longer and one shorter leg attachment side. Thus, when the two brackets 110 are arranged facing one another as shown in FIG. 4, they are oriented with one longer attachment side and one shorter attachment side on each side of the central rail.

Each of the brackets 110 includes a generally triangular central web 112, with each web having an upper end 114, a first edge 116, an opposite second edge 118, and a lower portion 120. The first edge 116 of the central web 112 has a first leg attachment set 122 extending therefrom, with the second edge 118 has a second leg attachment set 124 extending therefrom. A first leg inner attachment flange 126 extends from the first edge 116 of each bracket 110 and is bent or folded to lie normal to the plane of its central web. Second leg inner attachment flanges 128 extend from the opposite second edges 118 of each of the brackets 110. Each of these inner attachment flanges 126 and 128 has an upper end 130 generally conterminous with the upper ends 114 of each bracket 110 and extends downwardly from the upper end of its bracket. Each of the shorter first leg inner flanges 126 also has an opposite lower end 132*a*, with the opposite longer second leg inner flanges having opposite lower ends 132*b*. The spans between the upper ends 130 and lower ends 132*a* or 132*b* of each inner flange define their inner flange heights, respectively 134*a* for the shorter first leg inner flanges and 134*b* for the longer second leg inner flanges.

Each of the leg attachment sets 122 and 124 further includes a leg pivot limit flange, respectively first and second leg limit flanges 136 and 138 extending from the lower portion 120 of the central web 112 of each bracket 110. The upper edges of these leg pivot limit flanges are conterminous with the lower edges of the corresponding inner attachment flanges 126 and 128 and serve to limit both the extension and the folding of the sawhorse legs L1 through L4, as explained further below.

Outer leg attachment flanges 140 and 142 extend respectively from each of the leg pivot limit flanges and normal thereto and to the plane of the respective central web to lie parallel to the corresponding inner leg attachment flange 126 and 128. Each of the outer leg attachment flanges includes an upwardly extending ear, respectively 144 and 146, with each ear overlying the lower portion of the corresponding inner attachment flange 126*a* and 128 to define a leg attachment receptacle, respectively 148 and 150, therebetween. Thus, each of the four sawhorse legs is pivotally captured between its inner leg flange and corresponding ear of the outer leg flange, i.e., the first and third legs L1 and L3 are captured between inner flanges 128 and corresponding outer flange ears 146 and the second and fourth legs L2 and L4 are captured between their inner flanges 126 and corresponding outer flange ears 144. The rail R is not shown in FIG. 4 for clarity in the drawing Fig., but will be seen to be essentially the same as the rail R shown in FIGS. 1 through 3, affixed between the rail attachment flanges 156 of the two brackets 110 of FIG. 4.

It will be seen that the first and fourth leg inner flanges 128 of each bracket 110 have considerably greater heights 134*b* than the height 134*a* of the second and third leg inner flanges 126 of the brackets. This results in the leg inner and outer pivot passages 152*a*, 154*a* of the first and fourth leg inner flanges and ears, i.e., the inner flanges 128 extending from the second edges 118 of each bracket, being somewhat farther below the corresponding leg pivot passages 152*b*, 154*b* of the second and third leg inner flanges and ears, as all of the components of the leg attachment sets 122 of the taller inner flange sides of each bracket 110 are displaced downwardly or farther from the respective apex or upper end 114 of the brackets, than is the case for the components of the leg attachment sets 124 of the shorter inner flange sides of the brackets. The relative heights of these various components, i.e., their distances from the upper ends 114 of the brackets, are predetermined to position the inner and outer pivot passages 152*b*, 154*b* of the second and third leg attachment sets 122 so that the second and third legs L2 and L3 lie immediately adjacent the rail R when the two legs L2 and L3 are folded, as shown in broken lines in FIG. 4 of the drawings. The greater distance of the pivot passages 152*a*, 154*a* from the apex or upper end 114 of each bracket 110 results in those legs L1 and L4 folding to lie outboard of the second and third legs L2 and L3 extending from the brackets 110, as shown in FIG. 4.

Each of the brackets 110 illustrated in FIG. 4 are identical to one another, and must have substantially the same height as the brackets 10*a* and 10*b* of FIGS. 1 through 3 in order to provide the lower positioned first and fourth leg attachment sets 124 and their inner and outer pivotal leg attachment passages 152*a*, 154*a* of each bracket. Accordingly, the central webs 112 of the two brackets 110 each have sufficient area to allow an accessory attachment passage 160 to be formed in both webs. The accessory attachment passage 160 serves the same function as the corresponding passage 60 of the bracket 10*b* of FIGS. 1 through 3, i.e., it allows the belt clip or similar attachment structure of a retractable steel tape, etc. to be conveniently hung on the lower edge of the passage.

Conventional bolts and nuts as shown in FIGS. 2 and 3, are used to pivotally secure the legs L1 through L4 in their respective leg receptacles 148 and 150 and to immovably affix the opposite ends of the rail R between the respective rail attachment flanges 156 and 158. These bolt and nut assemblies may be tightened as desired to adjust the friction of the legs L1 through L4 relative to the inner and outer leg attachment flanges. These fastener assemblies also strengthen the entire sawhorse apparatus by tying each inner and outer leg attachment flange pair together, with the solid material of the upper end of each leg preventing the collapse of the two plates toward one another. The result is an extremely sturdy and solid structure.

The leg attachment passages 152*a* through 154*b* formed through the various inner and outer leg attachment flanges 126, 128 and ears 144, 146 are precisely located to limit the legs L1 through L4 in both their extension and retraction, or more accurately, the legs L1 through L4 are positioned precisely when they are initially positioned for drilling attachment holes through the upper ends of the legs, using the various flange and ear attachment passages as guides. When properly attached legs L1 through L4 are extended, the outboard edges of the legs contact the inner surfaces of the corresponding leg pivot limit flanges 136 and 138, limiting extension of the legs to an orientation normal to the rail R. Conversely, when the legs are folded, the outer edges of the legs contact the upper edges 164 of the corresponding limit flanges to prevent the legs from pivoting past parallel to the rail R. In some instances, it may be desirable to affix the legs L1 through L4 immovably in their brackets 110. This may be accomplished by driving locking pins (e.g., nails, wood screws, etc.) into preformed locking pin passages 166 formed through the outer attachment flanges 140, 142 and leg pivot limit flanges 136 and 138.

In conclusion, the folding sawhorse brackets provide an economical means of assembling a sawhorse that may be folded compactly for storage and transport. Each of the embodiments may be economically manufactured from an inexpensive blank of sheet metal stock, and cut and bent to form the finished bracket. While the embodiment of FIGS. 1 through 3 requires two different brackets 10*a* and 10*b*, it has the advantage of providing one smaller bracket of the two, thus requiring less material and perhaps providing certain advantages in packaging. The second embodiment of FIG. 4 has the advantage of identical brackets for each end of the assembled sawhorse, with each bracket facing the other. While both brackets of the second embodiment are of the same size as the larger bracket 10*b* of the first embodiment, they both may include an accessory attachment passage and may also nest reasonably compactly for efficient packaging.

It is to be understood that the present invention is not limited to the embodiments described above, but encompasses any and all embodiments within the scope of the following claims.

I claim:

1. A pair of folding sawhorse brackets, each of the brackets comprising:

a central web having an upper end, a first edge, a second edge opposite the first edge, and a lower portion;

a first and a second leg attachment members extending from the first edge and the second edge of the central web, respectively, each of the leg attachment members having a pair of leg pivot passages formed therethrough adapted to secure a sawhorse leg pivotally therein, the leg pivot passages of the second leg being spaced farther from the upper end of the central web than the leg pivot passages of the first leg, so that sawhorse legs pivotally attached to the second leg attachment member are disposed outwardly of sawhorse legs pivotally attached to the first leg attachment member when the legs are folded parallel to one another, each said leg attachment member comprises mutually opposed first and second leg inner attachment flanges extending from the first edge and the second edge of the central web, respectively, adjacent the upper end thereof and normal thereto, each of the inner attachment flanges having an upper end and a lower end defining an inner flange height therebetween, the inner flange height of the second leg inner attachment flange being greater than the inner flange height of the first leg inner attachment flange; and each of the leg attachment members further comprises mutually opposed first and second leg outer attachment flanges extending from the first edge and the second edge of the central web, respectively, adjacent the lower portion thereof and normal thereto, each of the outer attachment flanges having an ear extending upwardly therefrom, each of the ears overlying the respective one of the inner attachment flanges and defining a leg attachment receptacle therebetween, each of the leg attachment receptacles of the second edge being farther from the upper end of the central web than each of the leg attachment receptacles of the first edge; and first and second rail attachment flanges extending upwardly and outwardly from the upper end of the central web and defining a passage to affix a sawhorse rail therein.

2. The pair of folding sawhorse brackets according to claim 1, wherein each of the outer attachment flanges has a leg locking pin passage therethrough.

3. The pair of folding sawhorse brackets according to claim 1, further including mutually opposed first and second leg pivoting limit flanges extending from the lower portion of the central web of each of the brackets.

4. The pair of folding sawhorse brackets according to claim 3, wherein each of the limit flanges has a leg locking pin passage therethrough.

5. The pair of folding sawhorse brackets according to claim 1, wherein the central web of each of the brackets has at least one accessory attachment passage formed therethrough.

6. The pair of folding sawhorse brackets according to claim 1, further including a sawhorse rail extending between the rail attachment flanges of the pair of brackets and a sawhorse leg pivotally extending from each said leg attachment member of each of the brackets.

* * * * *